US005696543A

United States Patent [19]

Koizumi et al.

[11] Patent Number: 5,696,543

[45] Date of Patent: Dec. 9, 1997

[54] RECORDING HEAD WHICH DETECTS TEMPERATURE OF AN ELEMENT CHIP AND CORRECTS FOR VARIATIONS IN THAT DETECTED TEMPERATURE, AND CARTRIDGE AND APPARATUS HAVING SUCH A HEAD

[75] Inventors: Ryoichi Koizumi, Yokohama; Yasutomo Watanabe, Hiratsuka, both of Japan

[73] Assignee: Canon Kabushiki Kaisha, Tokyo, Japan

[21] Appl. No.: 352,586

[22] Filed: Dec. 9, 1994

[30] Foreign Application Priority Data

Dec. 10, 1993 [JP] Japan ..... 5-310220

[51] Int. Cl.[6] ..... B41J 2/04

[52] U.S. Cl. ..... 347/17; 347/67

[58] Field of Search ..... 347/14, 17, 58, 347/67, 56, 57; 219/499, 505

[56] References Cited

U.S. PATENT DOCUMENTS

| | | | |
|---|---|---|---|
| 4,117,723 | 10/1978 | Maravich | 374/183 |
| 4,313,124 | 1/1982 | Hara | 347/9 |
| 4,345,262 | 8/1982 | Shirato et al. | 347/10 |
| 4,429,321 | 1/1984 | Matsumoto | 347/59 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,899,180 | 2/1990 | Elhatem et al. | 347/59 |
| 5,175,565 | 12/1992 | Ishinaga et al. | 347/67 |
| 5,227,812 | 7/1993 | Watanabe et al. | 347/50 |
| 5,485,182 | 1/1996 | Takayanagi et al. | 347/17 |

FOREIGN PATENT DOCUMENTS

| | | | |
|---|---|---|---|
| 562786 | 9/1993 | European Pat. Off. | 347/17 |

OTHER PUBLICATIONS

Graf, Rudolf F., "Radio Shack Unabridged Dictionary of Electronics", p. 72, 1974.

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A liquid ejecting recording head using thermal energy to eject liquid for recording an image, includes an element chip having a plurality of electrothermal transducer elements for producing thermal energy to create bubbles to ejecto the liquid; a temperature detecting element disposed on the element chip to detect a temperature of the chip; liquid passages, disposed on the chip, corresponding to the electrothermal transducer elements having an opening at an end; correcting means for correcting an output of the temperature detecting element.

31 Claims, 5 Drawing Sheets

RECORDING HEAD WHICH DETECTS TEMPERATURE OF AN ELEMENT CHIP AND CORRECTS FOR VARIATIONS IN THAT DETECTED TEMPERATURE, AND CARTRIDGE AND APPARATUS HAVING SUCH A HEAD

FIELD OF THE INVENTION AND RELATED ART

The present invention relates to a recording element chip, an ink jet head comprising the recording element chip, and an ink jet recording apparatus comprising the same, which are employed in a recording system of the ink jet type, in particular those which are employed in a recording system of the bubble jet type comprising electrothermal transducer elements.

As for a recording head employed in the ink jet recording system, the liquid ejecting recording head constituted of the bubble jet system employing the electrothermal transducer element has been known. The liquid ejecting recording head uses thermal energy, which is generated by the electrothermal transducer element such as a heat generating resistor or the like, to eject liquid such as ink onto recording medium.

Since the thermal energy generated within the above recording head is partially accumulated in the liquid, the temperature of the recording head gradually rises as a recording operation continues. Such increase in the recording head temperature affects the ink viscosity. In other words, the amount of the ink ejected out of the recording head changes in response to the temperature increase, resulting in variances in the diameter of a dot created by the ink ejected onto the recording medium, which invites deterioration of image quality. Therefore, means for preventing the recording head temperature increase has been proposed, which detects the recording head temperature, and regulates the recording head operation in response to the detected temperature. Below, a circuit for detecting the recording head temperature will be described.

FIG. 9 is a schematic structural view of a chip containing a circuit for detecting the temperature of an ink jet recording head.

This chip 31 comprises heat generating resistors 34 and an aluminum wire temperature sensor 33 as a temperature sensor, which are formed on a piece of substrate.

As the temperature of the chip 31 increases, the resistance value of the aluminum wire temperature sensor 33 increases, and as the chip temperature decreases, the resistance value of the aluminum wire temperature sensor 33 becomes smaller. Therefore, the recording head temperature can be detected by detecting the change in the resistance value of the aluminum wire temperature sensor 33.

Thus, when the recording head temperature detected by the temperature sensor provided on the chip becomes excessive, a countermeasure, such as impeding the head from being driven, is taken to solve the above problem of temperature increase.

When the recording head temperature is detected in the above manner, the variance in the resistivity of the aluminum wire temperature sensor 33, which occurs due to the variance in the wire (film) thickness and/or condition under which the wire is etched during the formation of the aluminum wire temperature sensor 33 on the substrate, creates a problem. In other words, when the resistivity of the aluminum wire temperature sensor 33 mounted on the recording head varies from one head to another, the temperature detecting circuit outputs a different temperature value from one head to another under the same thermal conditions. As a result, it becomes impossible to carry out a stable recording operation. This is a problem that must be solved.

SUMMARY OF THE INVENTION

A primary object of the present invention is to provide a liquid ejecting recording head chip, an ink jet head comprising the head chip, and an ink jet recording apparatus comprising the same, which can eliminate the variance in the chip temperature and head temperature detected by the above temperature detecting sensor, so that the temperature can be accurately detected to carry out a stable recording operation.

Another object of the present invention is to provide an ink jet recording apparatus capable of carrying out such correction so that a high quality image can be recorded.

According to a primary aspect of the present invention, there is provided a liquid ejecting recording head using thermal energy to eject liquid for recording an image, including an element chip having a plurality of electrothermal transducer elements for producing thermal energy to create bubbles to ejecto the liquid; a temperature detecting element disposed on the element chip to detect a temperature of the chip; liquid passages, disposed on the chip, corresponding to the electrothermal transducer elements having an opening at an end; correcting means for correcting an output of the temperature detecting element.

According to another aspect of the present invention, there is provided a liquid ejecting recording head using thermal energy go eject liquid for recording images, includes an element chip having a plurality of electrothermal transducer elements for producing thermal energy to create bubbles to eject the liquid; a temperature detecting element disposed on the chip to detect a temperature of the chip; correcting means, disposed on the element chip, for correcting an output of the temperature detecting element; and liquid passages, disposed on the chip corresponding to the electrothermal transducer elements and having an opening at an end.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Below, the embodiments of the present invention will be described with reference to the drawings.

Though each embodiment example below will be described with reference to an aluminum wire temperature sensor as a representative temperature sensor that is liable to bear the production errors, the present invention is also applicable to temperature sensors constituted of a diode or a transistor.

Also, in the embodiments below, the employed liquid is ink, but the present invention is not limited by these embodiment examples, but instead, is applicable to any liquid that is usable with the liquid ejecting head.

Further, a terminology, "recording," is not limited to "recording characters and/or images on the recording medium such as paper or OHP." It includes "recording the characters and/or images on some other recording medium such as fabric, thread, plastic plate, leather or the like." In other words, it simply means "application of ink onto any recording medium," and has nothing to do with whether the recorded images have meaning or not.

Further, another terminology, "elements on the substrate," means not only the "elements on the substrate surface," but also, "those underneath the surface." Another terminology, "built-in," does not means that independent elements are "attached" to the substrate, but means that they are integrally formed on the substrate through semiconductor manufacturing steps or the like.

EMBODIMENT 1

In this embodiment example, in order to correct the variance in the temperature sensor resistivity, which is the source of the above problem, correcting means is connected to the temperature sensor.

Figure 1:
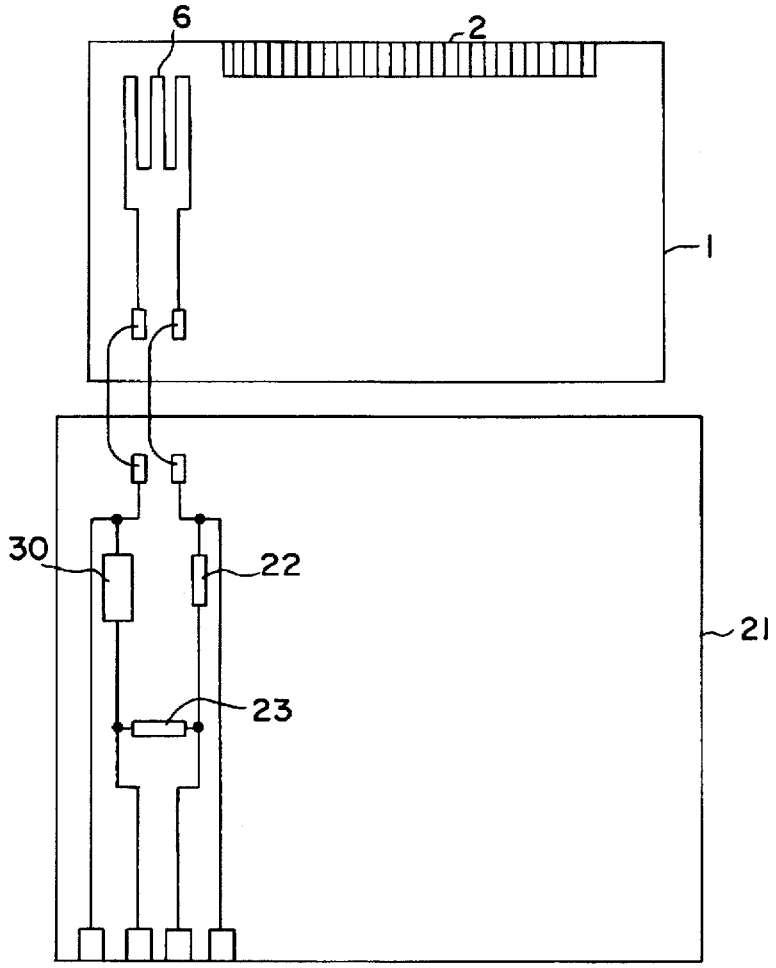
FIG. 1 is a schematic structural view of a primary example of embodiment of a liquid ejecting head chip comprising correcting means according to the present invention.

FIG. 1 is a schematic view of a liquid ejecting head (ink jet head) comprising a trimming resistor as the correcting means for correcting the temperature detecting element (temperature sensor).

This design comprises two chips, that is, an electrothermal element chip (element chip) 1 comprising electrothermal transducers 2 that generate thermal energy, and a wiring chip (PCB) 21 comprising wiring for transmitting signals to the element chip 1. An aluminum wire temperature sensor 6 as a temperature detecting means is formed on the element chip 1. A trimming resistor 30 as the corrective means, and fixed resistors 22 and 23, are formed on the wiring chip 21.

In the above design, a bridge circuit is formed by the aluminum wire temperature sensor 6 formed on the element chip 1, and the trimming resistor 30 and fixed resistors 22 and 23 formed on the wiring chip 21, and the resistance value of the trimming resistor 30 is set (the trimming resistor 30 is trimmed), so that the resistivity of the aluminum wire temperature sensor 6 falls within a predetermined range. Next, a process of trimming the trimming resistor 30 will be described.

Figure 2:
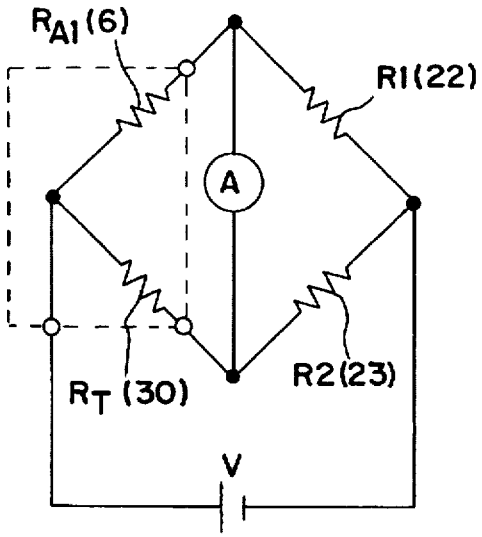
FIG. 2 is an equivalent circuit diagram of a temperature detecting circuit according to the present invention.

FIG. 2 is an equivalent circuit diagram for the temperature detecting circuit chip illustrated in FIG. 1.

This circuit is a bridge circuit in which a sub-circuit comprising serially connected resistors $R_{A1}$ and $R_1$, and a sub-circuit comprising serially connected resisters $R_T$ and $R_2$ are connected in parallel. This bridge circuit also comprises an ammeter A interposed between the contact point of the resisters $R_{A1}$ and $R_1$, and the contact point of the resisters $R_T$ and $R_2$, wherein the resistor $R_{A1}$ is equivalent to the aluminum wire temperature sensor 6; resistor $R_T$, to the trimming resistor 30; resistor $R_1$, to the fixed resistor 22; and resistor $R_2$ is equivalent to the fixed resistor 23.

As for the process of trimming the trimming resistor 30, the chips constituting the above bridge circuit, that is, the element chip 1 and wiring chip 21, are actually mounted in the recording head, and then, the value of the resistor $R_T$ is set so as satisfy the following equation (1) with respect to the resistance value of the resistor $R_{A1}$ at a predetermined temperature:

$$R_T/R_1=R_{A1}/R_2 \quad (1)$$

When the trimming resistor 30 is formed in the manner described above, the recording head temperature is detected by detecting the temperature triggered resistance value change of the aluminum wire temperature sensor $R_{A1}$, with reference to the resistance value of the trimming resistor $R_T$ 30. As a result, it is possible to form a temperature detection circuit in which the resistivity variance of the aluminum wire temperature sensor 6 is corrected; therefore, high quality images can be stably obtained.

EMBODIMENT 2

In the above embodiment example, the correcting means is provided on a chip (wiring chip) different from the element chip on which the temperature detecting means is disposed.

This embodiment depicts a modified version of the preceding example. In this embodiment, the design is modified in view of the simplification of the production steps, and a reduction in the production cost.

Figure 3:
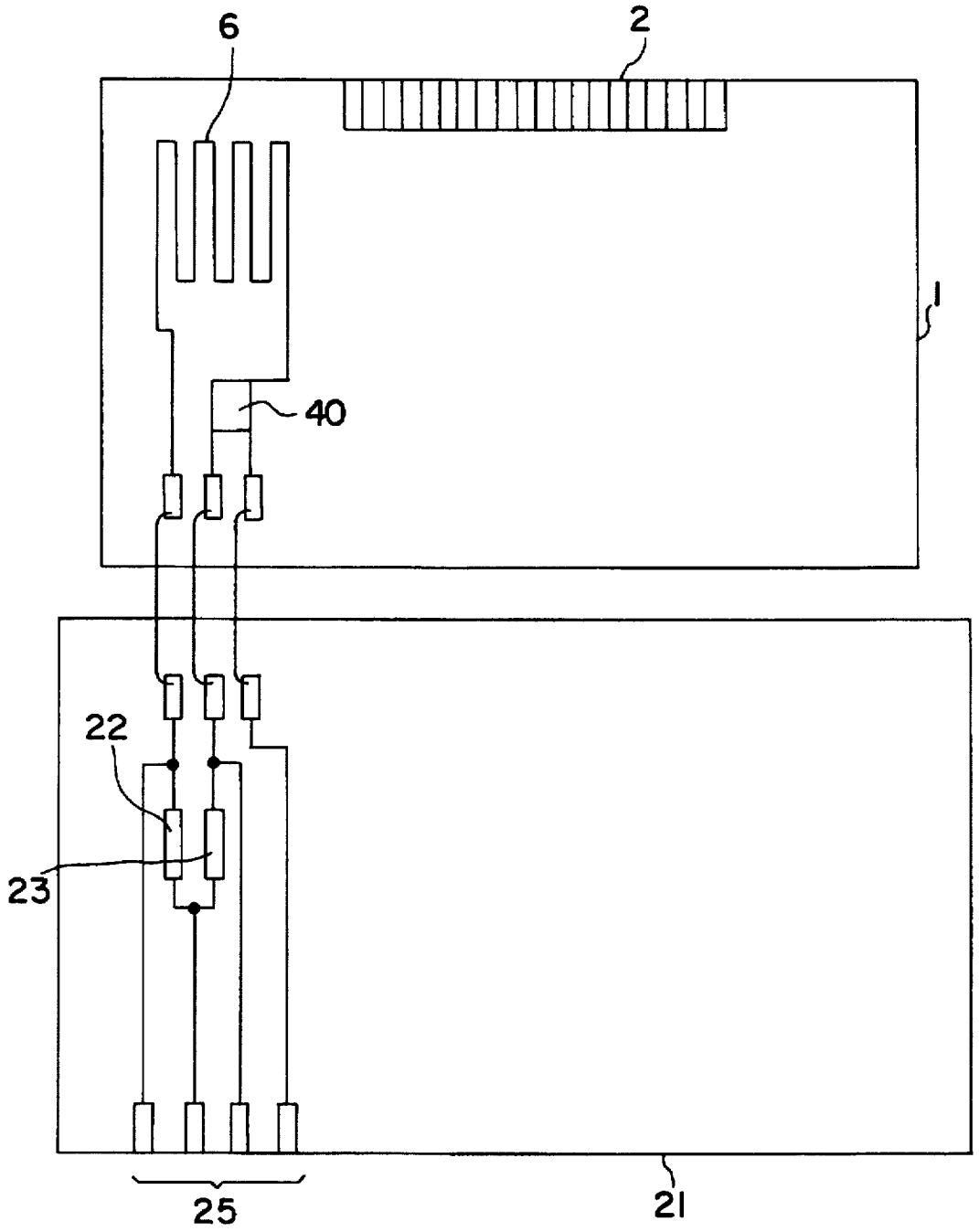
FIG. 3 is a schematic structural view of a second example of the embodiment of the ink jet recording head chip comprising the temperature detecting circuit according to the present invention.
Figure 4:
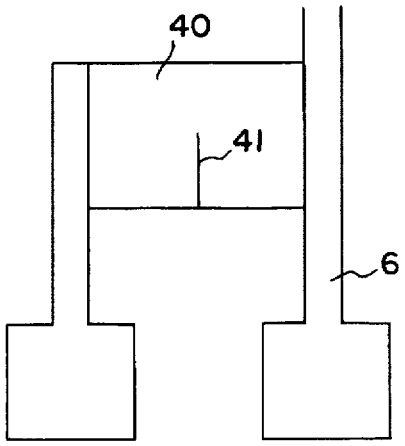
FIG. 4 is an enlarged view of a correcting resistor illustrated in FIG. 3.

FIG. 3 is a schematic structural view of the element chip and wiring chip of a second example of the embodiment of liquid ejecting recording head according to the present invention, and FIG. 4 is an enlarged view of the trimming resistor illustrated in FIG. 3.

The recording head of this embodiment comprises an element chip comprising build-in electrothermal transducers 2, and a wiring chip 21. The element chip 1 comprises a built-in aluminum wire temperature sensor 6 as the temperature detecting element and a built-in trimming resistor 60 as the correcting means, and the wiring chip 21 comprises fixed resistors 22 and 23, each of which is connected to the aluminum wire temperature sensor 6. The equivalent circuit, which is formed by connecting the aluminum wire temperature sensor 6, trimming resistor 40, and fixed resistors 22 and 23 in the above described manner, is the same as the bridge circuit illustrated in FIG. 2.

The trimming resistor 40 in the chip of this embodiment is formed during a wafer processing operation for forming the electrothermal element chip 1. It has an approximately rectangular configuration as shown in FIG. 4, and is interposed between a pair of lead wires for the aluminum wire temperature sensor, across which a voltage is applied, with its opposing edges being connected to the corresponding lead wire. The trimming resistor 40 has a slit 41 that determines the value of the resistor $R_T$ illustrated in FIG. 2.

As for the method for trimming the trimming resistor 40, the resistance value of the aluminum wire temperature sensor 6 at a predetermined temperature, that is, the resistance value of the resistor $R_{A1}$ in FIG. 2 in this case, is first obtained. Next, the obtained value of the resistor $R_{A1}$ is used to calculate a resistance value of the $R_T$ that satisfies the equation (1). At this time, resistors $R_1$ and $R_2$ having the same value are employed; therefore, the resistance value of the resistor $R_T$ equals that of the resistor $R_{A1}$. Also, the resistance value of the resistor $R_T$ is determined by the size of a slit 41 formed in the trimming resistor 40. Thus, the trimming resistor 40 is trimmed by forming the slit 41 having a size appropriate to match its resistance value to that of the resistor $R_{A1}$. The slit 41 is formed during the wafer inspection in which the element chip is inspected.

During the wafer inspection, when the substrate temperature is 25° C. and the ammeter disposed within the bridge circuit shows "0," the temperature coefficient of resistance (TCR) of the aluminum wire temperature sensor is:

TCR $4.15\times10^{-3}$/°C.

When $HfB_2$ is used as the material for the trimming resistor 40, the TCR' of this trimming resistor 40 is:

TCR'$5\times10^{-6}$/°C.

On other words, the resistance value of the resistor $R_{A1}$ changes at a rate larger by two orders in magnitude than that of the resistor $R_T$. As a result, the resistance value change of the resistor $R_T$ becomes negligible. Thus, the effect of the temperature change on the correcting resistor itself can be reduced by making the TCR of the correcting resistor 40 smaller than the TCR of the resistance value of the resistor $R_{A1}$, that is, the TCR of the temperature sensor 6. It is only necessary for the ratio between two TCRs to be no less than 10 times, though it is preferable for it to be no less than 100 times.

When $HfB_2$ is used as the material for the trimming resistor 10 as described above, it is possible to form a bridge circuit that depends on the thermal change of the resistance value of the resistor $R_{A1}$, that is, the aluminum wire temperature sensor 6.

Further, when the same material as the one used for the electrothermal transducer (heat generating resistor) 2 that ejects the liquid is used for the trimming resistor 40, the trimming resistor 40 can be formed at the same time as when the electrothermal transducer 2 is formed during the wafer production.

When the correcting resistor is to be built in on the element chip as it is in this embodiment, it can be formed while semiconductor is processed during the element chip production. Therefore, the manufacturing can be simplified, and also, the correcting resistor and recording head can be reduced in size.

Further, the correcting means for keeping the thermal change of the resistance value of the temperature detecting elements within a predetermined variance range can be trimmed during the wafer checking process. Therefore, the process can be simplified and the cost can be reduced.

Further, the resistance value of the reference resistor is determined by the size of the slit formed in the reference resistor. Therefore, when the slit is form so as for its size to satisfy the equation (1) with respect to the resistance value of the temperature detecting resistor at a predetermined temperature, the resistance value change of the temperature detecting resistor can be obtained with reference to the resistance value of the referential resistor.

EMBODIMENT 3

Figure 5:
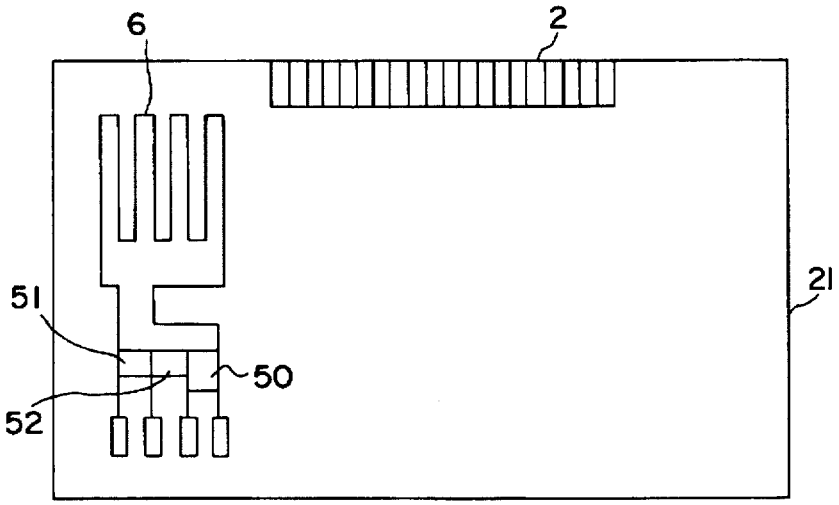
FIG. 5 is a schematic structural view of a third example of the embodiment of the ink jet recording head chip comprising the temperature detecting circuit according to the present invention.
Figure 6:
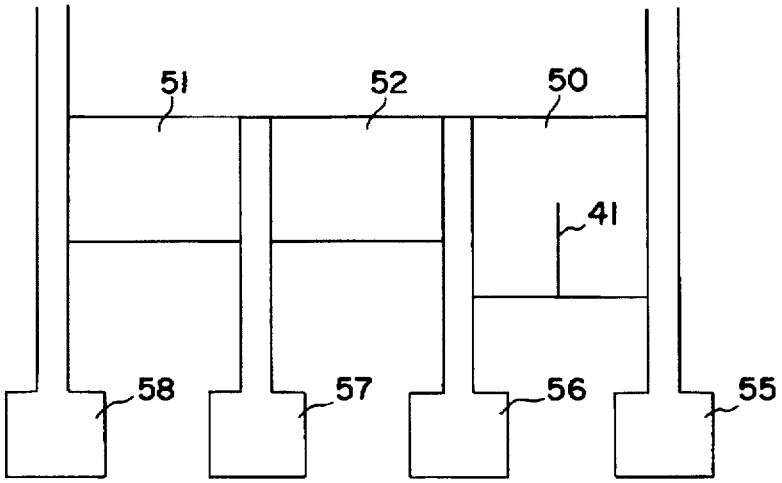
FIG. 6 is an enlarged view of the correcting resistor illustrated in FIG. 5.

FIG. 5 is a schematic structural view of a third example of the embodiment of the element chip of the ink jet recording head according to the present invention. FIG. 6 is an enlarged view of the trimming resistor and fixed resistors.

In the case of the ink jet recording head of this embodiment, the aluminum wire temperature sensor 6 is built in the element chip 1 comprising the electrothermal transducers 2. The trimming resistor 50 and fixed resistors 51 and 62 are built in the wiring of the aluminum wire temperature sensor 6.

Referring to FIG. 6, the aluminum wire temperature sensor 6 of this chip is provided with an input line 55, a return line 57, a line 56, and a line 58, wherein the lines 55 and 57 are connected to a DC power source, and the lines 56 and 58 are connected to an ammeter. The trimming resistor 50 and fixed resistors 51 and 52 all have a substantially rectangular configuration. The trimming resistor 50 is interposed between the lines 55 and 56; the fixed resistor 51, between the lines 56 and 57; and the fixed resistor 52 is interposed between the lines 57 and 58.

This temperature detecting circuit is also equivalent to the bridge circuit illustrated in FIG. 2. Therefore, a bridge circuit that depends on the thermal change of the resistance value of the aluminum wire temperature sensor 6, can be formed by forming a slit in the trimming resistor 50 in the same manner as it is in the second embodiment.

Also in this embodiment, the temperature sensor, correcting resistor, and fixed resistance resistors are formed on the element chip as they are in the preceding embodiments, enabling these resistors to be formed during the wafer processing step of the element chip manufacturing operation. Further, the correcting resistor is trimmed during the wafer checking step. As a result, the manufacturing operation can be simplified, and the cost can be reduced. Additionally, the fixed resistance resistors are built in the substrate, the correction can be effected with precision.

EMBODIMENT 4

Next, a liquid ejecting head to which the present invention is applicable will be described.

Figure 7:
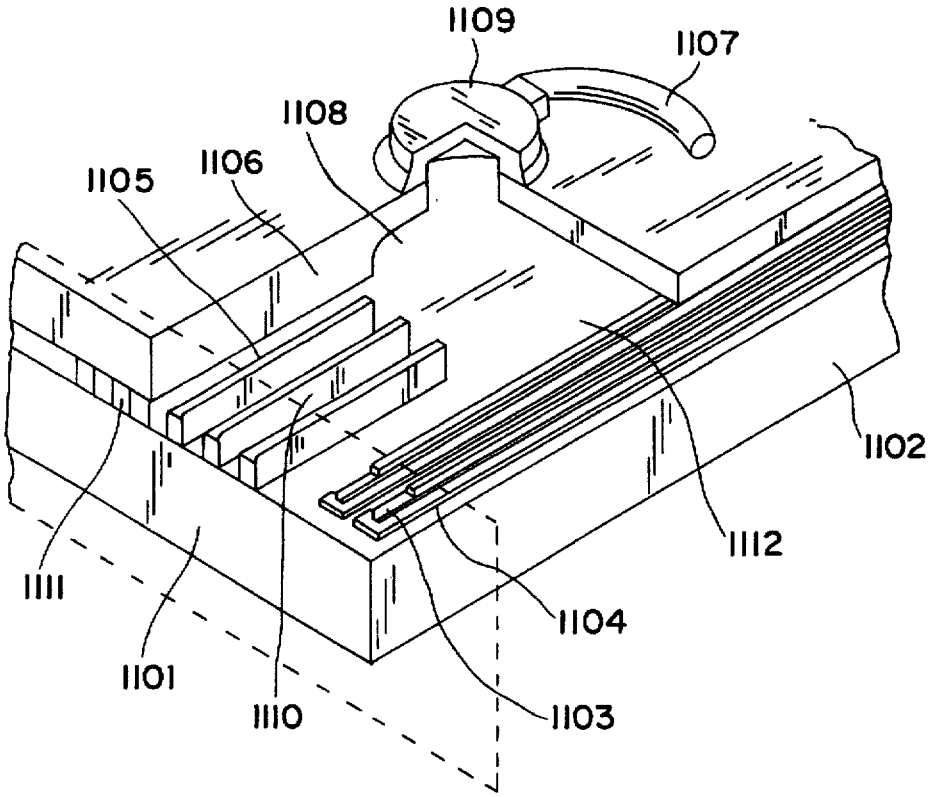
FIG. 7 is a partially cutaway schematic view of a liquid ejecting head according to the present invention.
Figure 9:
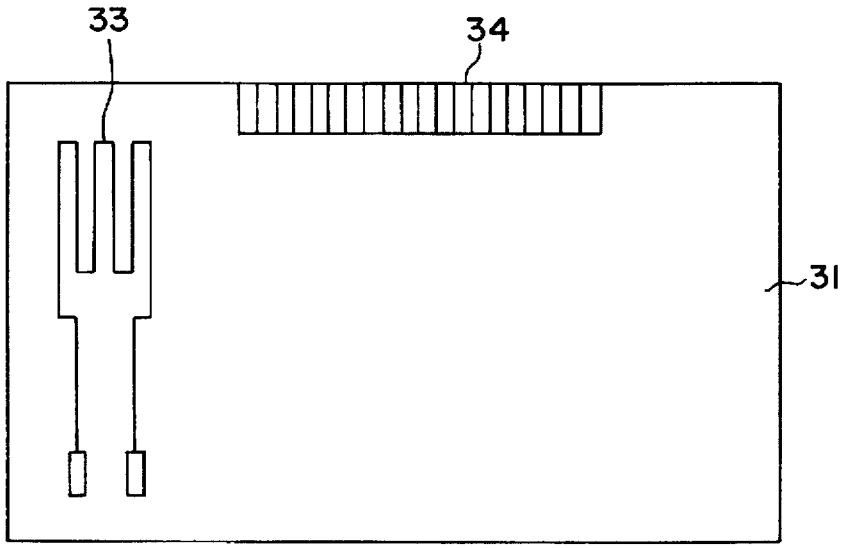
FIG. 9 is a schematic structural view of an ink jet recording head chip according to the prior art.

FIG. 7 is a schematic view of such an ink jet recording head, and it illustrates an ink jet recording head comprising electrothermal transducers 1103, electrodes 1104, liquid passage walls 1105, and a top plate 1106, which are formed through semiconductor manufacturing processes such as etching, deposition, sputtering, or the like. A recording liquid 1112 is delivered from an unillustrated liquid storing chamber to a common liquid chamber 1108 of the recording head 1101, through a liquid delivery tube 1107. A reference numeral 1109 designates a liquid delivery tube connector. The liquid delivered into the common liquid chamber 1108 is delivered further into a liquid passage 1110 due to the so-called capillary phenomenon, and forms a meniscus at the end of the liquid passage, that is, an opening at an ejection orifice surface (orifice surface), being thereby stably held there. While the liquid is held in this manner, electric power is applied to the electrothermal transducer 1103. Then, the liquid on the electrothermal transducer surface is rapidly heated up, developing bubbles in the liquid passage. As the bubbles expand and contract, the liquid is ejected from the ejection orifices 111, in the form of a liquid droplet.

With the employment of the structure described in the foregoing, it is possible to arrange the ejection orifices in such a high density as 16 nozzles/mm, or a total ejection orifice count of 123 or 256 at the orifice surface, and also, it is possible to produce a multi-nozzle ink jet recording head in which a large number of the ejection orifices are arranged to cover the entire recording width.

Next, a description will be given as to an ink jet recording apparatus in which the above described temperature detecting circuit chip is mounted.

FIG. 5 is an external oblique view of an example of ink jet recording apparatus (IJRA) in which the recording head in accordance with the present invention is installed as an ink jet head cartridge (IJC).

In FIG. 5, a reference numeral 120 designates an ink jet head cartridge (IJC) comprising a recording head having a group of nozzles for ejecting ink onto the recording surface of a sheet of recording paper delivered onto the surface of a platen 124 and an ink container for containing ink to be supplied to the recording head. A reference numeral 116 designates a carriage HC that holds an IJC 120. It is connected to a part of a driving belt 118 that transmits the driving force from a driving motor 117, and is fitted on a pair of parallel guide shafts 119A and 119B, being enabled to slide thereon so that the IJC 120 can be reciprocated across the entire width of the recording paper.

A reference numeral 126 designates a head recovery apparatus that carries out en ejection orifice performance recovery operation such as eliminating the ink with increased viscosity out of the nozzles. It is disposed at one end of the path of the IJC 120, for example, at a location facing the home position, and is driven through a transmission mechanism by the driving force from a motor 122. As for the operation of the head recovery apparatus 126, first, the IJC 120 is capped by a cap 126A of the head recovery apparatus, and then, the ink is sucked out of the ejection orifices by an appropriate sucking means provided within the head recovery apparatus 126, or is pressure-fed by a proper pressuring means provided along the ink delivery passage to the IJC 120, so that the ink is discharged out of the ejection orifices. Further, the head recovery apparatus 126 caps the IJC at the end of the recording operation or the like to protect it.

A reference numeral 130 designates a silicon rubber blade as a wiping member, which is disposed on the lateral surface of the head recovery apparatus, being held by a blade supporting member 130A in a cantilever-like manner. It comes in contact with the ejection orifice surface of the IJC 120 as it is driven by a motor 122 and a transmission mechanism 123 in the same manner as the head recovery apparatus 126. With this setup in place, the blade 130 is projected into the path of the IJC 120 after the ejection performance recovery operation is carried out by the head recovery apparatus 126, and as the IJC 120 moves, the condensed liquid, dust, and the like on the ejection surface of the IJC 120 are wiped away.

The present invention is effective when applied to the recording head and recording apparatus, which employ the ink jet recording system, in particular when applied to those employing the ink jet recording system that uses thermal energy to form flying liquid droplets.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response.

The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

The ink jet recording apparatus may be used as an output terminal of an information processing apparatus such as word processor, computer or the like, as a copying apparatus combined with an image reader or the like, or as a facsimile machine having information sending and receiving functions.

As described above, according to the present invention, the trimming resistor and fixed resistors are formed as an integral part of the wiring for the aluminum wire temperature sensor on the electrothermal element chip of the recording head; therefore the present invention is effective to reduce the component count, as well as the recording head cost.

Further, the trimming step for confining the resistance value variance of the temperature sensor within a predetermined range is carried out while the wafer is checked, which makes it possible to eliminate the step for trimming the trimming resistor when it is assembled into the recording head. Therefore, the present invention is effective to simplify the manufacturing operation.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting recording head for mounting on a printing apparatus and which ejects a liquid for recording images, comprising:

an element chip having a plurality of electrothermal transducer elements for producing thermal energy to create bubbles to eject the liquid;

a temperature detecting element disposed on said element chip to detect a temperature of said element chip;

a plurality of liquid passages, disposed on the element chip, corresponding to the electrothermal transducer elements, each said liquid passage having an opening at an end;

correcting means for correcting a variation of the temperature detected by said temperature detecting element.

2. A liquid ejecting recording head for mounting on a printing apparatus and which ejects a liquid for recording images, comprising:

an element chip having a plurality of electrothermal transducer elements for producing thermal energy to create bubbles to eject the liquid;

a temperature detecting element for detecting a temperature of said element chip;

correcting means for correcting a variation of said temperature detecting element, said correcting means including said temperature detecting element and a correcting element; and a plurality of liquid passages, disposed on the element chip corresponding to the electrothermal transducer elements and each said liquid passage having an opening for ejecting the liquid at an end.

3. A liquid ejecting recording head according to claim 1 or 2, wherein said temperature detecting element has metallic wire.

4. A liquid electing recording head according to claim 1 or 2, wherein said temperature detecting element has a diode or transistor.

5. A liquid ejecting recording head according to claim 1 or 2, wherein said correcting means has a film resistor.

6. A liquid electing recording head according to claim 5, wherein said correcting means has a trimming resistor.

7. A liquid ejecting recording head according to claim 1 or 2, wherein a temperature dependency of said correcting means is less than that of said temperature detecting element.

8. A liquid electing recording head according to claim 7, wherein a temperature coefficient of resistance of said correcting means is no more than 1/10 of that of said temperature detecting element.

9. A liquid ejecting recording head according to claim 1 or 2, wherein a bridge circuit including includes the temperature detecting sensor and correcting means is formed.

10. A liquid ejecting recording head according to claim 1 or 2, wherein the liquid passages are filled with liquid.

11. A liquid ejecting recording head according claim 1, 2, wherein the liquid is ink.

12. A liquid ejecting recording head cartridge for ejecting a liquid to record an image, comprising:

a liquid ejecting recording head which ejects the liquid for recording the image, including an element chip having a plurality of electrothermal transducer elements for producing thermal energy to create bubbles to eject the liquid, a temperature detecting element disposed on said element chip for detecting a temperature on said chip, correcting means for correcting a variation of said temperature detecting element, said correcting means including said temperature detecting element and a correcting element, and a plurality of liquid passages, disposed on said element chip corresponding to the electrothermal transducer element, and each said liquid passage having an opening for ejecting the liquid at an end; and a liquid container for containing the liquid to be supplied to the recording head.

13. A liquid ejecting recording head according to claim 12, wherein said temperature detecting element has a diode or transistor.

14. A liquid ejecting recording head according to claim 12, wherein said correcting means has a film resistor.

15. A liquid ejecting recording head according to claim 14, wherein said correcting means has a trimming resistor.

16. A liquid ejecting recording head according to claim 12, wherein a temperature dependency of said correcting means is less than that of said temperature detecting element.

17. A liquid ejecting recording head according to claim 16, wherein a temperature coefficient of resistance of said correcting means is no more than 1/10 of that of said temperature detecting element.

18. A liquid ejecting recording head according to claim 17, wherein a bridge circuit including said the temperature detecting sensor and correcting means is formed.

19. A liquid ejecting recording head according to claim 12, wherein the liquid passages are filled with liquid.

20. A liquid ejecting recording head according to claim 12 or 19, wherein the liquid is ink.

21. A liquid ejecting recording apparatus for ejecting a liquid to record an image, comprising:

a liquid ejecting recording head that elects the liquid for recording the image, including an element chip having a plurality of electrothermal transducer elements for producing thermal energy to create bubbles to eject the liquid, a temperature detecting element disposed on said element chip for detecting a temperature of said element chip, a plurality of liquid passages, disposed on said element chip, corresponding to the electrothermal transducer elements and each said liquid passage having an opening at an end, and correcting means for correcting a variation of the temperature detected by said temperature detecting element; and conveying means for conveying a recording medium for receiving the liquid ejected from the liquid ejecting recording head.

22. A liquid ejecting recording apparatus that ejects a liquid to record images, comprising:

a liquid ejecting recording head which ejects the liquid for recording the images, including an element chip having a plurality of electrothermal transducer elements for producing thermal energy to create bubbles to eject the liquid, a temperature detecting element disposed on said element chip to detect a temperature of said element chip, a plurality of liquid passages, disposed on said element chip, corresponding to the electrothermal transducer elements and each said liquid passage having an opening at an end, and correcting means for correcting a variation of the temperature detected by said temperature detecting element; and a driving signal supplying means for supplying a signal for driving the liquid ejecting head, to the liquid ejecting recording head.

23. A liquid ejecting recording apparatus for ejecting a liquid to record an image, comprising:

a liquid ejecting recording head that ejects the liquid for recording the image, including an element chip having a plurality of electrothermal transducer elements for producing thermal energy to create bubbles to eject the liquid, a temperature detecting element for detecting a temperature of said element chip, correcting means for correcting a variation of said temperature detecting element, said correcting means including said temperature detecting element and a correcting element, and a plurality of liquid passages, disposed on said element chip, corresponding to the electrothermal transducer elements, each said liquid passage having an opening for ejecting the liquid at an end; and conveying means for conveying a recording medium for receiving the liquid ejected from the liquid ejecting recording head.

24. A liquid ejecting recording apparatus that ejects a liquid to record images, comprising:

a liquid ejecting recording head which ejects the liquid for recording the images, including an element chip having a plurality of electrothermal transducer elements for producing thermal energy to create bubbles to eject the liquid, a temperature detecting element for detecting a temperature of said element chip, correcting means for correcting a variation of said temperature detecting element, said correcting means including said temperature detecting element and a correcting element, and a plurality of liquid passages, disposed on said chip, corresponding to the electrothermal transducer elements and each said liquid passage having an opening for ejecting the liquid at an end; and a driving signal supplying means for supplying a signal for driving the liquid ejecting head, to the liquid ejecting recording head.

25. A liquid ejecting recording head according to claims 22, 22, 23 or 24, wherein said temperature detecting element has a diode or transistor.

26. A liquid ejecting recording head according to claims 22, 22, 23 or 24, wherein said correcting means has a film resistor.

27. A liquid ejecting recording head according to claim 22, 22, 23 or 24, wherein said correcting means has a trimming resistor.

28. A liquid ejecting recording head according to claims 22, 22, 23 or 24, wherein said temperature dependency of the correcting means is less than that of said temperature detecting element.

29. A liquid ejecting recording head according to claims 22, 22, 23 or 24, wherein the temperature coefficient of resistance of the correcting means is no more than 1/10 of that of said temperature detecting element.

30. A liquid ejecting recording head according to claim 22, 22, 23 or 24, wherein a bridge circuit including said temperature detecting sensor and correcting means is formed.

31. A liquid ejecting recording head according to claims 22, 22, 23 or 24, wherein the liquid is ink.

* * * * *

UNITED STATES PATENT AND TRADEMARK OFFICE

CERTIFICATE OF CORRECTION

PATENT NO. : 5,696,543

DATED : December 9, 1997

INVENTOR(S) : RYOICHI KOIZUMI ET AL.

It is certified that error appears in the above-identified patent and that said Letters Patent is hereby corrected as shown below:

[57] ABSTRACT

Line 4, "ejecto" should read --eject--.
Line 9, "correcting" (first occurrence) should read --and correcting--.

COLUMN 2

Line 23, "ejecto" should read --eject--.
Line 31, "go" should read --to--; and "includes" should read --including--.

COLUMN 3

Line 34, "means" should read --mean--.

COLUMN 4

Line 3, "resisters" should read --resistors--.
Line 6, "resisters" (both occurrences) should read --resistors--.
Line 45, "build-in" should read --built-in--.

COLUMN 5

Line 4, "the $R_T$" should read --the resistor $R_T$--.
Line 23, "On" should read --In--.
Line 35, "resistor 10" should read --resistor 40--.
Line 58, "form" should read --formed--.

UNITED STATES PATENT AND TRADEMARK OFFICE

CERTIFICATE OF CORRECTION

PATENT NO. : 5,696,543

DATED : December 9, 1997

INVENTOR(S) : RYOICHI KOIZUMI ET AL.

It is certified that error appears in the above-identified patent and that said Letters Patent is hereby corrected as shown below:

COLUMN 6

Line 7, "62" should read --52--.
Line 33, "Additionally," should read --Additionally, since--.
Line 60, "orifices 111," should read --orifices 1111,--.

COLUMN 7

Figure 8:
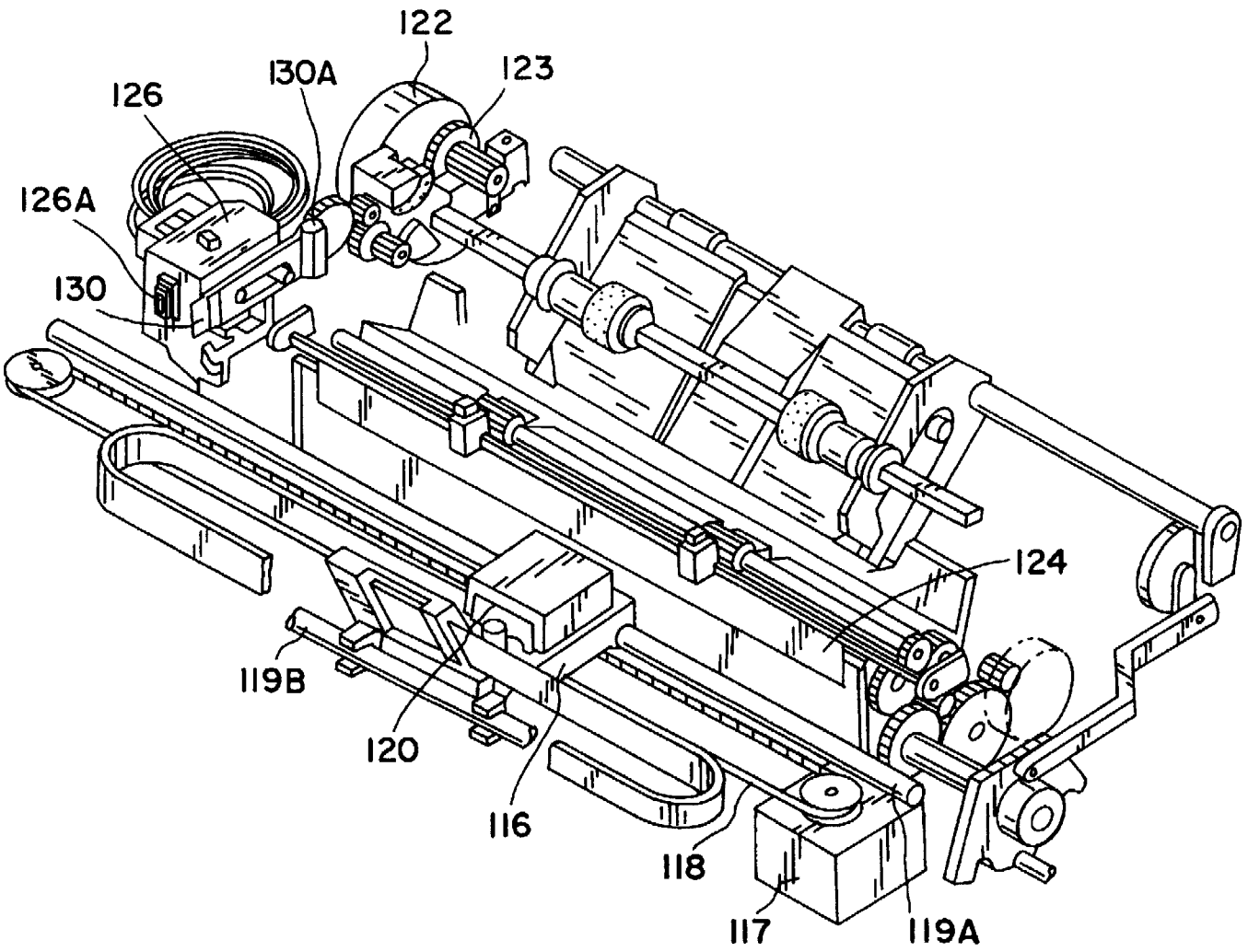
FIG. 8 is a schematic oblique view of an ink jet recording apparatus comprising the temperature detecting circuit according to the present invention.

Line 4, "FIG. 5" should read --FIG. 8--.
Line 8, "FIG. 5," should read --FIG. 8,--.
Line 21, "en" should read --an--.

COLUMN 8

Line 25, "head" should read --heads--.

COLUMN 9

Line 24, "end;" should read --end; and--.
Line 48, "electing" should read --ejecting--.
Line 59, "electing" should read --ejecting--.
Line 64, "includes" should be deleted.

COLUMN 10

Line 1, "claim 1, 2," should read --to claim 1 or 2,--.
Line 10, "on" should read --of--.
Line 37, "said" should be deleted.
Line 45, "elects" should read --ejects--.

UNITED STATES PATENT AND TRADEMARK OFFICE

CERTIFICATE OF CORRECTION

PATENT NO. : 5,696,543

DATED : December 9, 1997

INVENTOR(S) : RYOICHI KOIZUMI ET AL.

It is certified that error appears in the above-identified patent and that said Letters Patent is hereby corrected as shown below:

COLUMN 12

```
Line 12, "22, 22, "should read --21, 22,--.
Line 15, "22, 22, "should read --21, 22,--.
Line 17, "claim" should read --claims--.
Line 18, "22, 22, "should read --21, 22,--.
Line 21, "22, 22, "should read --21, 22,--.
Line 25, "22, 22, "should read --21, 22,--.
Line 28, "claim" should read --claims--.
Line 29, "22, 22, "should read --21, 22,--.
Line 33, "22, 22, "should read --21, 22,--.
```

Signed and Sealed this

Seventh Day of September, 1999

*Attest:*

*Attesting Officer*

Q. TODD DICKINSON

*Acting Commissioner of Patents and Trademarks*